US006279173B1

(12) United States Patent
Denzin et al.

(10) Patent No.: US 6,279,173 B1
(45) Date of Patent: Aug. 28, 2001

(54) DEVICES AND METHODS FOR TOILET VENTILATION USING A RADAR SENSOR

(75) Inventors: Peter W. Denzin, Glenbeulah; Michael J. Merritt, Sheboygan, both of WI (US); Fred Judson Heinzmann, Los Altos, CA (US); Kyle L. Petrich, Kowloon (HK); Jennifer A. Schlee, La Honda, CA (US); John F. Larkin, Santa Clara, CA (US); Erik C. Lincicum, La Honda, CA (US); Peter O. Sorensen, Half Moon Bay, CA (US)

(73) Assignee: D2M, Inc., Palo Alto, CA (US)

( * ) Notice: Subject to any disclaimer, the term of this patent is extended or adjusted under 35 U.S.C. 154(b) by 0 days.

(21) Appl. No.: 09/291,130

(22) Filed: Apr. 12, 1999

(51) Int. Cl.[7] ..... E03D 9/04

(52) U.S. Cl. ..... 4/213

(58) Field of Search ..... 4/213, 216

(56) References Cited

U.S. PATENT DOCUMENTS

| | | | | |
|---|---|---|---|---|
| 1,997,695 | | 4/1935 | Nielsen et al. . | |
| 2,100,962 | | 11/1937 | Juntunen . | |
| 3,295,147 | | 1/1967 | Meyer . | |
| 3,571,824 | | 3/1971 | Poister . | |
| 3,585,651 | | 6/1971 | Cox . | |
| 3,626,554 | | 12/1971 | Martz . | |
| 3,691,568 | | 9/1972 | Martz . | |
| 3,914,805 | * | 10/1975 | Dolan | 4/227 |
| 4,031,574 | | 6/1977 | Werner . | |
| 4,044,408 | | 8/1977 | Pearson . | |
| 4,141,091 | * | 2/1979 | Pulvori | 4/313 |
| 4,165,544 | | 8/1979 | Barry . | |
| 4,166,298 | | 9/1979 | Pearson . | |
| 4,251,888 | | 2/1981 | Turner . | |
| 4,583,250 | | 4/1986 | Valarao . | |
| 5,060,323 | | 10/1991 | Shaw . | |
| 5,125,119 | * | 6/1992 | Munoz | 4/213 |
| 5,167,039 | * | 12/1992 | Sim | 4/216 |
| 5,210,884 | | 5/1993 | Redford . | |
| 5,231,705 | | 8/1993 | Ragusa . | |
| 5,255,395 | | 10/1993 | Millette . | |
| 5,257,421 | | 11/1993 | Rose et al. . | |
| 5,259,072 | | 11/1993 | Trombley . | |
| 5,299,326 | | 4/1994 | Alexander . | |
| 5,299,327 | | 4/1994 | Wilkerson . | |
| 5,305,472 | | 4/1994 | Eger . | |
| 5,321,856 | | 6/1994 | Gastesi . | |
| 5,325,544 | | 7/1994 | Busch . | |
| 5,333,321 | | 8/1994 | Redford . | |

(List continued on next page.)

FOREIGN PATENT DOCUMENTS

| | | | |
|---|---|---|---|
| 3210985 | * | 3/1983 | (DE) . |
| 0550388 | * | 7/1993 | (EP) . |
| 0717289 | * | 6/1996 | (EP) . |
| 9904285 | * | 1/1999 | (WO) . |

*Primary Examiner*—Charles E. Phillips
(74) *Attorney, Agent, or Firm*—Merchant & Gould P.C.

(57) ABSTRACT

A toilet ventilation device includes a housing that defines an air inlet aperture and an air outlet aperture. Within the housing are an air movement apparatus for drawing air into the device, a filter for removing malodorous elements in the air, and a radar sensor for activating the air movement apparatus in response to the presence of a user and, optionally, deactivating the air movement apparatus when the user leaves. The toilet ventilation device is configured and arranged to draw air, using the air movement apparatus, from the toilet, through the air inlet aperture, into contact with the filter, and out the air outlet aperture. In one embodiment, the toilet ventilation device is disposed over the overflow conduit of the toilet to draw air from the bowl of the toilet, through the overflow conduit, and into the toilet ventilation device. The entire toilet ventilation device is preferably disposed within a tank of a toilet.

26 Claims, 11 Drawing Sheets

U.S. PATENT DOCUMENTS

| | | | | |
|---|---|---|---|---|
| 5,341,521 | | 8/1994 | Redford . | |
| 5,345,471 | | 9/1994 | McEwan . | |
| 5,345,617 | | 9/1994 | Jahner et al. . | |
| 5,353,443 | | 10/1994 | Sim . | |
| 5,355,536 | | 10/1994 | Prisco . | |
| 5,355,537 | | 10/1994 | Redford . | |
| 5,361,070 | | 11/1994 | McEwan . | |
| 5,361,422 | | 11/1994 | Vincent et al. . | |
| 5,369,810 | * | 12/1994 | Warren | 4/213 |
| 5,369,811 | | 12/1994 | Serre . | |
| 5,369,812 | | 12/1994 | Trombley . | |
| 5,369,813 | | 12/1994 | Goddard et al. . | |
| 5,386,594 | | 2/1995 | Hilton . | |
| 5,388,280 | | 2/1995 | Sim . | |
| 5,394,569 | | 3/1995 | Poirier et al. . | |
| 5,403,548 | | 4/1995 | Aibe et al. . | |
| 5,416,930 | | 5/1995 | Waldner et al. . | |
| 5,457,394 | | 10/1995 | McEwan . | |
| 5,465,094 | | 11/1995 | McEwan . | |
| 5,493,737 | | 2/1996 | Chu . | |
| 5,510,800 | | 4/1996 | McEwan . | |
| 5,512,834 | | 4/1996 | McEwan . | |
| 5,517,198 | | 5/1996 | McEwan . | |
| 5,519,400 | | 5/1996 | McEwan . | |
| 5,521,600 | | 5/1996 | McEwan . | |
| 5,523,760 | | 6/1996 | McEwan . | |
| 5,563,605 | | 10/1996 | McEwan . | |
| 5,573,012 | | 11/1996 | McEwan . | |
| 5,576,627 | | 11/1996 | McEwan . | |
| 5,581,256 | | 12/1996 | McEwan . | |
| 5,589,838 | | 12/1996 | McEwan . | |
| 5,606,747 | | 3/1997 | Dupont . | |
| 5,609,059 | | 3/1997 | McEwan . | |
| 5,610,611 | | 3/1997 | McEwan . | |
| 5,809,581 | | 9/1998 | Brown . | |
| 5,829,066 | | 11/1998 | Aibe . | |

* cited by examiner

DEVICES AND METHODS FOR TOILET VENTILATION USING A RADAR SENSOR

FIELD OF THE INVENTION

This invention relates to devices and methods for toilet ventilation. In particular, the invention relates to a toilet ventilation device disposed in a tank of a toilet and including a radar sensor, and methods therefor.

BACKGROUND OF THE INVENTION

A variety of devices are used to remove or reduce odors from air in restrooms and bathrooms. Ceiling fans are one example of such devices. Other examples include air filtration devices that remove odors from the vicinity of a toilet, including the bowl of the toilet. Some devices rely on the use of an electrically operated fan or suction apparatus to remove the air. The continuous operation of the fan or suction apparatus is typically not desirable because of the wear on the motor or other mechanical and electrical components of the fan or suction device and/or the continuous use of electricity.

Some conventional air filtration devices are designed for placement outside the toilet or attached to the toilet. One disadvantage of these devices is that the device is exposed and may not be aesthetically acceptable and/or may be subject to tampering. Other conventional air filtration devices are designed for operation in the toilet, however, many of these devices require modification (often extensive) of the toilet and/or a specially constructed toilet. For example, the device may require sealing of the toilet tank, attaching additional hoses or pipes to the toilet, and/or forming sensor windows in the tank or other portion of the toilet. These devices are typically not convenient or suitable for retrofitting existing toilets.

A number of air filtration devices have been developed that utilize switches to turn on and off the fan or suction device. Manual switches may be operated by a user, but are typically inconvenient. Accordingly, devices with automatic switches have been developed. One conventional type of switch is a pressure switch. The switch may be positioned, for example, underneath the toilet seat. The switch is actuated when a user sits on the toilet and released when the user stands up. A disadvantage of this type of pressure switch is that it is exposed and can be damaged, vandalized, or rendered nonfunctional by dirt, dust, or other contaminants.

Another type of conventional switch is an infrared sensor. Infrared light is emitted by an infrared source, such as a light emitting diode (LED), and reflected by a user to an infrared detector, such as a photocell. The use of infrared detection has several limitations. First, infrared radiation cannot penetrate most materials because of the short wavelength of the radiation. Thus, infrared emitters and detectors are typically either exposed or are positioned behind a window made of material that is transparent to infrared radiation. In addition, infrared sensors can be inadvertently or purposefully blocked by the presence of material, such as paper, dust, or cloth, in front of the emitter or detector.

Another disadvantage of infrared detection is that the reflectivity of objects, such as clothing, varies widely. Thus, the infrared detector must be sensitive to a wide variation in the strength of reflected signals. There is a risk that the detector may fail to detect a user with clothing or other articles that absorb or only weakly reflect infrared radiation. Furthermore, conventional infrared sensors do not discriminate with respect to distance of an object from the sensor. Thus, an infrared sensor might not discriminate between a person using a toilet and someone standing close to the toilet. These disadvantages of infrared detectors may cause faulty responses by the toilet ventilation device (e.g., continuous or intermittent operation of the fan or suction device).

SUMMARY OF THE INVENTION

Generally, the present invention relates to methods and devices for toilet ventilation using a radar sensor to control the operation of the device in response to presence and, optionally, absence of a user. One embodiment is a toilet ventilation device for disposition within a toilet, for example, in the tank of a toilet. The toilet ventilation device includes a housing that defines an air inlet aperture and an air outlet aperture. Within the housing are an air movement apparatus for drawing air into the device, a filter for removing malodorous elements in the air, and a radar sensor for activating the air movement apparatus in response to the presence of a user and, optionally, deactivating the air movement apparatus when the user leaves. The toilet ventilation device is configured and arranged to draw air, using the air movement apparatus, from the toilet, through the air inlet aperture, into contact with the filter, and out the air outlet aperture. In one mode of operation, the toilet ventilation device is disposed over the overflow conduit of the toilet to draw air from the bowl of the toilet, through the overflow conduit, and into the toilet ventilation device.

Another embodiment of the invention is a toilet ventilation device that includes a housing defining an air inlet aperture and an air outlet aperture, an air movement apparatus, and a radar sensor. The air movement apparatus and radar sensor are electrically coupled to activate the air movement apparatus in response to detection of a user. Both the air movement apparatus and radar sensor are disposed in the housing. The radar sensor includes a transmitter for emitting pulses of rf energy, a gated receiver for receiving reflections of the pulses of rf energy, and a processor for determining, in response to the reflections received by the receiver, whether a user is present.

Yet another embodiment of the invention is a method of removing malodorous elements using a toilet ventilation device disposed in a toilet, for example, in the tank of a toilet. A radar sensor senses whether a person is proximate the toilet. When a person is proximate the toilet, an air movement apparatus is turned on to draw air from a bowl of the toilet into the toilet ventilation device. Malodorous elements in the air are then removed using a filter. The radar sensor, air movement apparatus, and filter are all disposed in the toilet ventilation device.

The above summary of the present invention is not intended to describe each disclosed embodiment or every implementation of the present invention. The Figures and the detailed description which follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
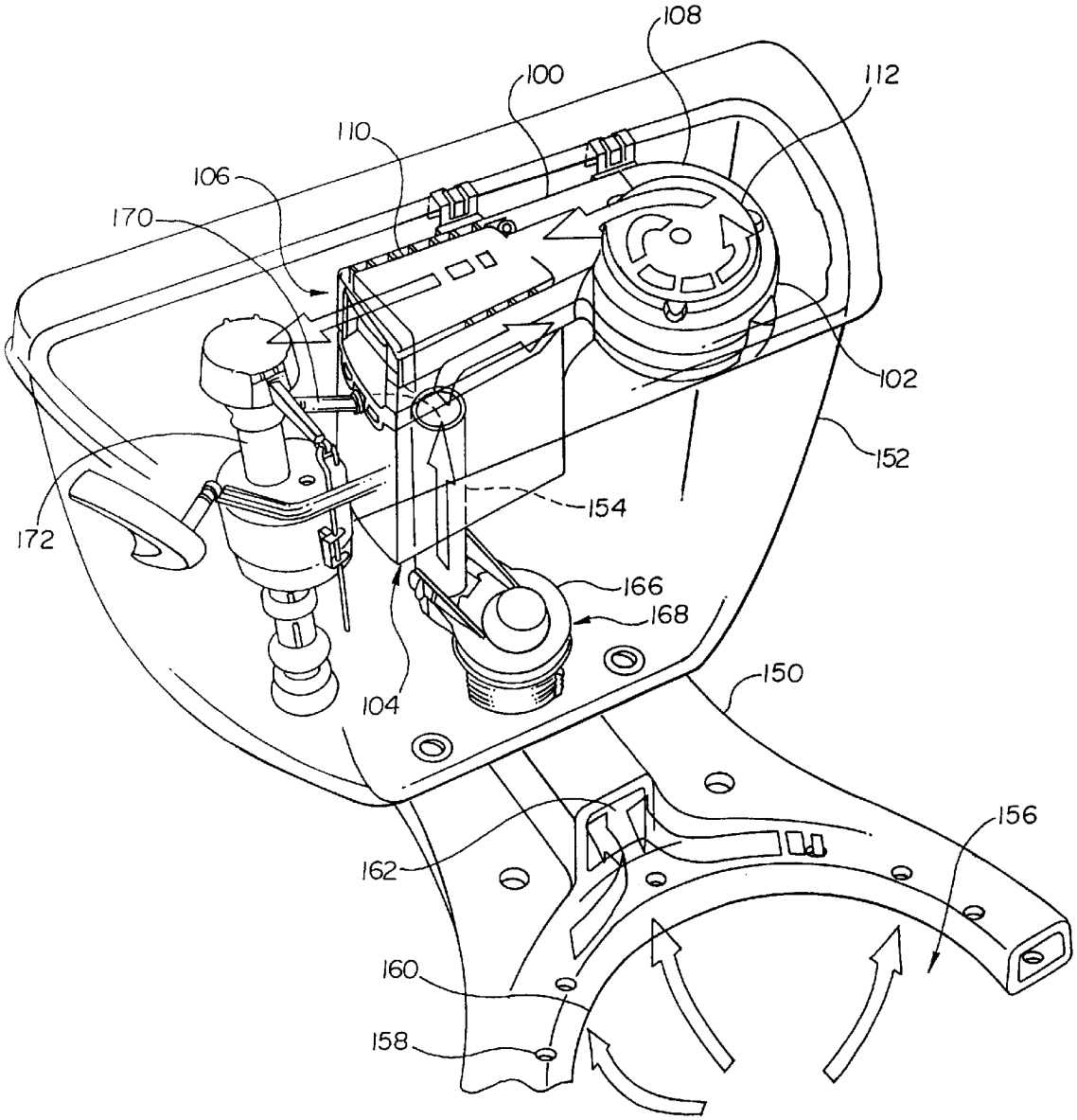
FIG. 1 is a perspective view of one embodiment of a toilet ventilation device, according to the invention, disposed in the tank of a toilet.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENT

The present invention is believed to be applicable to devices and methods for toilet ventilation. In particular, the present invention is directed to devices and methods for toilet ventilation using a radar sensor. While the present invention is not so limited, an appreciation of various aspects of the invention will be gained through a discussion of the examples provided below.

A toilet ventilation device includes a housing having an air inlet aperture and an air outlet aperture, an air movement apparatus, a filter, and a radar sensor for operating the air movement apparatus. Preferably, all of these components are disposed in the housing to provide a single, integrated unit. The toilet ventilation device, using the air movement apparatus, draws air into the housing via the air inlet aperture. The air is directed through the filter and out the air outlet aperture. The radar sensor turns on the air movement apparatus when a user is detected and, optionally, turns off the air movement apparatus when no user is detected. Alternatively, the device may be configured so that the air movement apparatus turns off after a selected amount of time (e.g., 5 minutes, 10 minutes, or 15 minutes).

In at least some embodiments, all of the components of the toilet ventilation device are disposed within the toilet. For example, the toilet ventilation device may be positioned completely within the body of the toilet, for example, in the tank of the toilet (if the toilet has a tank). Because the material of the toilet (e.g., porcelain) typically does not block radar signals, the radar sensor can be disposed unobtrusively in the tank or other portion of the toilet. There is no need for forming windows in the tank or other portion of the toilet, as would be needed for an infrared sensor placed within the toilet. In at least some instances, the toilet ventilation device can be used to retrofit an existing toilet without additional modification of the toilet.

Figure 2:
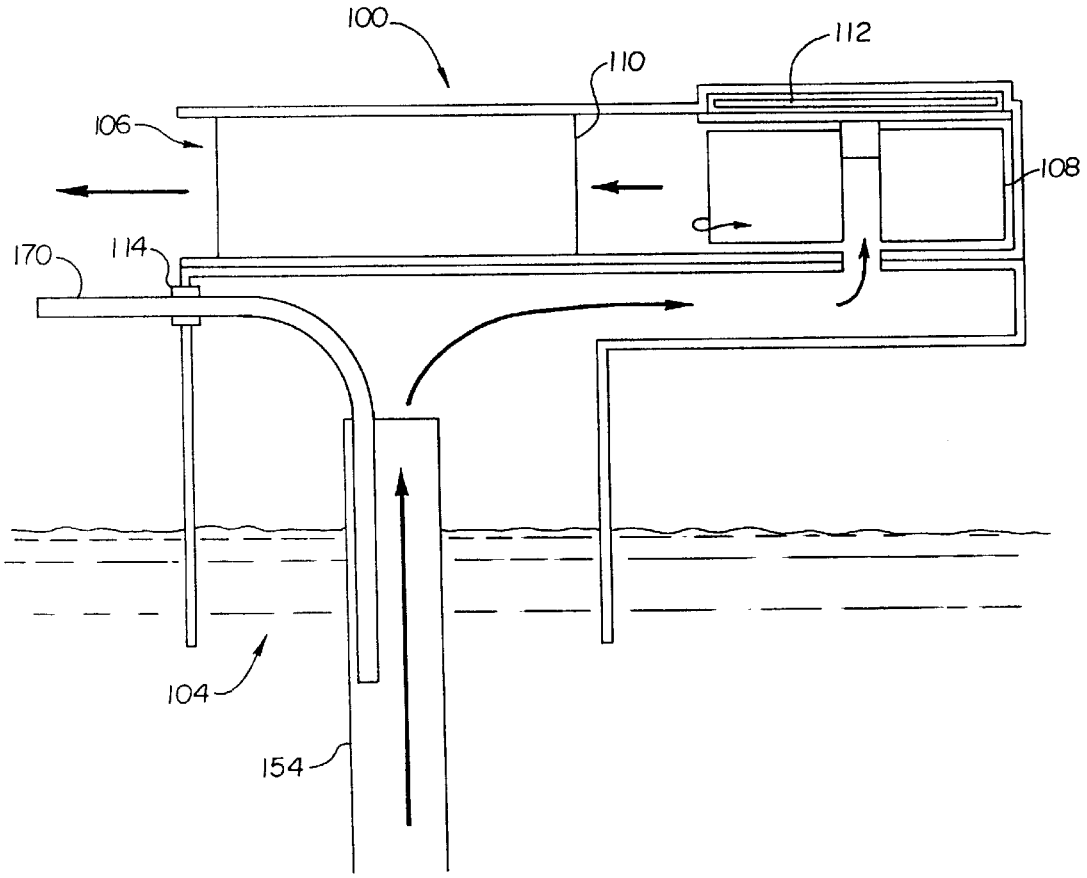
FIG. 2 is a schematic cross-sectional view of the toilet ventilation device of FIG. 1.

FIG. 1 illustrates one embodiment of a toilet ventilation device 100 disposed in the tank of a toilet and FIG. 2 illustrates schematically a cross-section of the toilet ventilation device 100. Although the toilet ventilation device is illustrated and described with respect to a device for placement in the tank of the toilet, it will be understood that the toilet ventilation device may be modified for positioning elsewhere within the toilet, for example, in the base of the toilet, or outside the toilet.

The toilet ventilation device 100 includes a housing 102, an air inlet aperture 104, an air outlet aperture 106, an air movement apparatus 108, a filter 110, and a radar sensor 112 (disposed on a circuit board). This embodiment of the toilet ventilation device 100 can be positioned over an overflow conduit 154 in the tank 152 of the toilet 150. In one example of operation, air is drawn, by the air movement apparatus 108, from a bowl 156 of the toilet 150, through one or more rim apertures 158 in the underside of the bowl rim 160, along the flushing conduit 162, through the overflow conduit 154, and into the toilet ventilation device 100.

The rim apertures 158, flushing conduit 162, and overflow conduit 154 are conventional elements in many varieties of toilets. When a user flushes the toilet, the flapper 166 is raised to expose an opening 168 into the flushing conduit 162 allowing water to flow from the tank 152 through the flushing conduit 162 and rim apertures 158 to rinse the bowl 156 and cause the flushing action for removal of waste. The illustrated toilet includes rim apertures that are holes or openings within a rim conduit of the toilet. Other toilets have a slotted rim rather than holes or openings. The overflow conduit 154 is used to remove water from the tank 152 if the water level rises above the top of the overflow conduit. The toilet typically also includes a refill tube 170 coupled to a water source 172. One end of the refill tube 170 is disposed in or above the overflow conduit 154 to refill the bowl 156 via the overflow conduit 154 after flushing and while the tank 152 is refilling. The toilet ventilation device 100 may include an opening 114 in the housing 102 for the refill tube 170.

It will be understood that the toilet ventilation device can be used with or adapted for use with a variety of toilets that do not contain all of these components or toilets that contain additional components. For example, the toilet ventilation device may be used in toilets that do not have tanks. The toilet ventilation device may be placed within the vitreous material of the toilet and coupled to the bowl by, for example, a conduit through which water is introduced into the bowl and/or a conduit that is specially provided to connect the bowl of the toilet and the toilet ventilation device. In some embodiments, the toilet ventilation device may be placed outside the toilet with the air inlet aperture of the device coupled to a conduit, formed in the body of the toilet, from the bowl of the toilet. In some instances, the toilet ventilation device may be disposed behind or on a restroom wall. A pipe, hose, or tube connects the toilet with the device.

Figure 3:
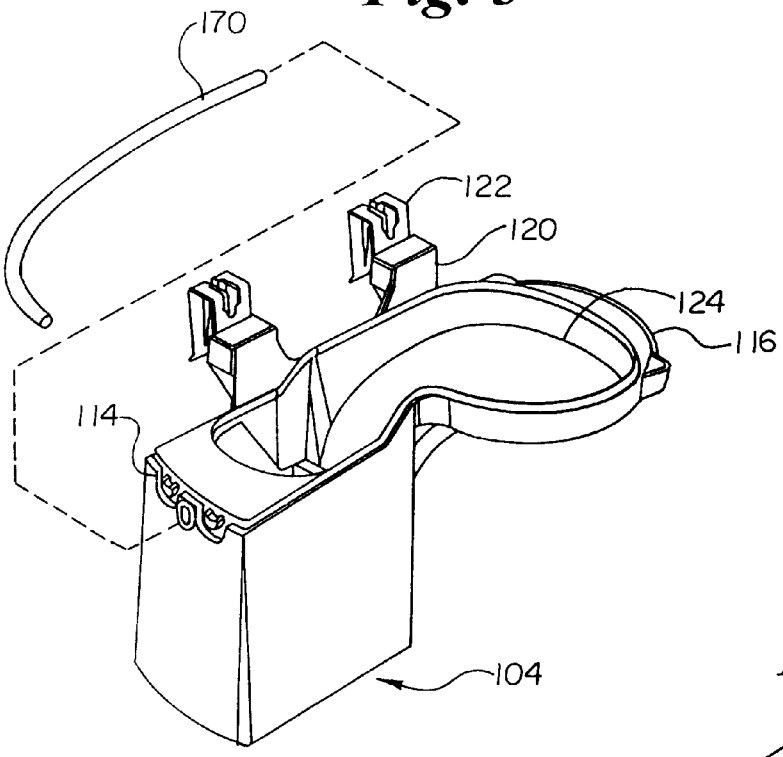
FIG. 3 is a perspective view of a lower portion of the housing of the toilet ventilation device of FIG. 1.
Figure 4:
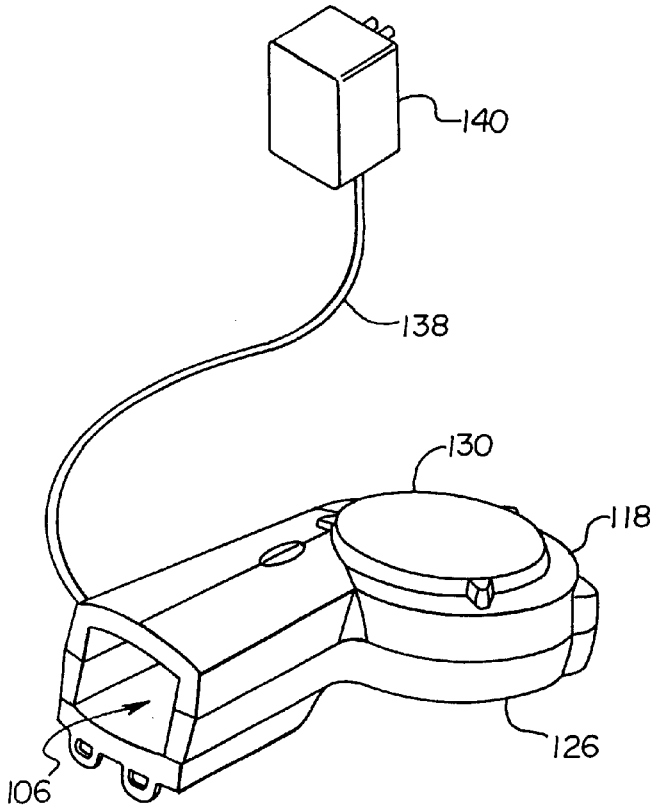
FIG. 4 is a perspective view of an upper portion of the housing of the toilet ventilation device of FIG. 1.

Returning to FIGS. 1 and 2, the housing 102 of the toilet ventilation device 100 is typically formed using a plastic material, such as polypropylene. The plastic material is typically resistant to degradation in air and water and, preferably, resistant to degradation by chemicals from in-tank cleaning products. The housing 102 can be formed as a single piece or in multiple pieces. FIGS. 3 and 4 illustrate one embodiment of a suitable housing 102 formed with a lower portion 116 (FIG. 3) and an upper portion 118 (FIG. 4). In the illustrated embodiment, the lower portion 116 includes the air inlet aperture 104, refill tube opening 114, and, optionally, a refill tube 170. In the embodiment illustrated in FIG. 3, the lower portion 116 of the housing 102 further includes a channel 124 through which air is directed from the air inlet aperture 104 to the air movement apparatus, as described below.

The air inlet aperture 104, in the illustrated embodiment, is typically large compared to the size of the overflow conduit 154. The advantage of this arrangement is that the overflow conduit 154 (and associated flushing conduit 162 and rim apertures 158) can be used to draw air from the bowl 156, but water can still easily flow into the overflow conduit 154 if the water level in the tank 152 rises too high. If the air inlet aperture 104 is smaller, the flow of water into the overflow conduit 154 may be impeded. Another advantage is that the wide air inlet aperture 104 reduces the likelihood that water will be drawn up (for example, by suction) into the region of the air movement apparatus 108 and/or filter 110 along with the air. In some embodiments, additional openings may be formed in the lower portion 116 of the housing to allow air and/or water to flow into or out of the housing. In at least some instances, the water in the tank 152 may rise up into the air inlet aperture 104 of the toilet ventilation device 100. This may facilitate drawing air from the bowl 156 via the air overflow conduit 154 instead of from the tank 152.

Yet another advantage of the large air inlet aperture is that the aperture can accommodate a variety of existing overflow conduits and positions of the overflow conduit relative to the other items in the tank. This facilitates the use of the fluid flow device in retrofitting existing toilets. It will be understood, however, that, in some embodiments, the air inlet aperture may be smaller, particularly, if the toilet ventilation device is connected to the toilet by a conduit specially provided for the device and/or the toilet is one of the types of toilets that does not use a tank.

FIG. 3 also illustrates a hanger assembly 120 for attaching the toilet ventilation device 100 to the tank 152. The hanger assembly 120 may include hooks 122 or other components, such as fasteners, screws, nut and bolt arrangements, and the like to hang, fasten, or otherwise attach the toilet ventilation device 100 to the tank 152. The hanger assembly 120 may be an integral part of the housing 102 (e.g., the lower portion 116 or another part of the housing) or the hanger assembly 120 may be configured to attach, cradle, support, adhere to, fasten to, or otherwise hold the toilet ventilation device 100 within the tank 152 of the toilet 150. The hanger assembly 120 may include adjustable components so that the position of toilet ventilation device 100 can be adjusted to fit with existing hardware in the toilet. For example, the hanger assembly 120 may be configured to adjust the position of the toilet ventilation device up or down within the toilet and/or to adjust the distance between the toilet ventilation device and sidewalls of the tank. An adjustable hanger assembly may facilitate retrofitting a variety of different existing toilets with toilet ventilation devices. Additionally or alternatively, the toilet ventilation device may be coupled to the overflow valve by, for example, a screw, clip, bolt, or other fastener.

Figure 5A:
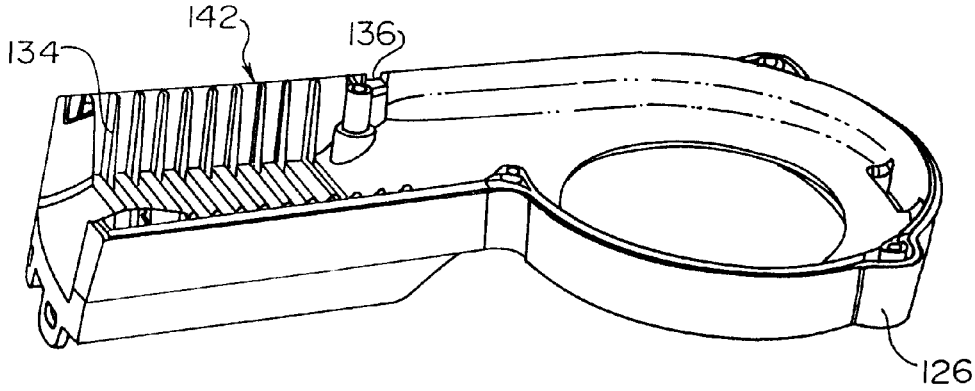
FIG. 5A is a perspective view of a base of the upper portion of the housing of FIG. 4.
Figure 5B:
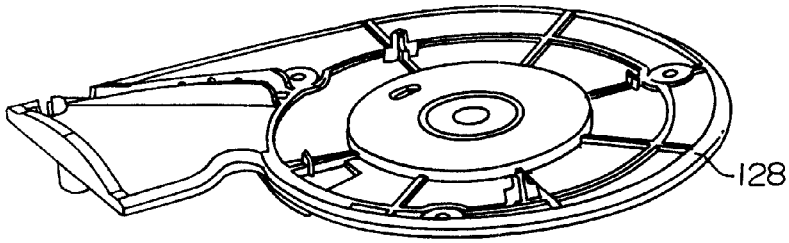
FIG. 5B is a perspective top view of a cover plate of the upper portion of the housing of FIG. 4.
Figure 5C:
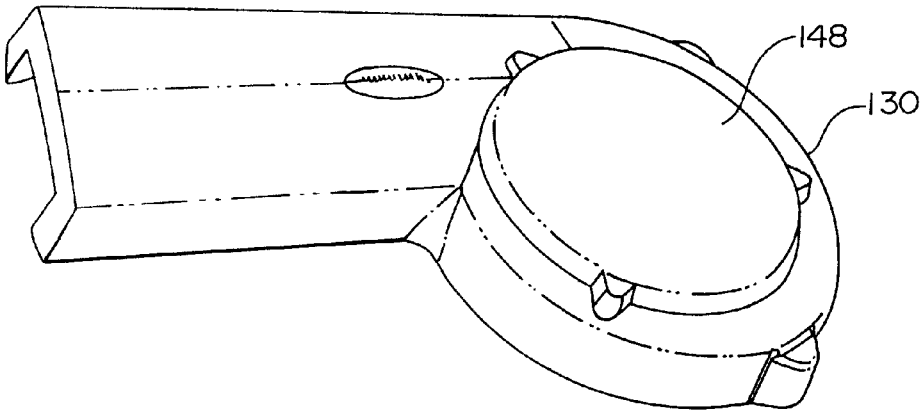
FIG. 5C is a perspective top view of a cover of the upper portion of the housing of FIG. 4.

The upper portion 118 of the housing 102 can be formed as a single piece or as multiple pieces. FIGS. 5A to 5D illustrate one embodiment of the upper portion 118 of the housing. This embodiment includes a base 126 (FIG. 5A), a cover plate 128 (FIGS. 5B and 5D), and a cover 130 (FIG. 5C). The base 126 is configured to fit with the lower portion 116 of the housing 102. The cover plate 128 fits in the cover 130 and the base 126 and cover 130 are configured to mate together.

The base 126, the plate 128, the cover 130, and the lower portion 116 can include any of a variety of fasteners, such as clips, interlocking parts, and the like, and/or members for cooperating with fasteners, such as adhesives, screws, nails, nuts and bolts, rivets, staples, and the like, for fastening or otherwise holding the base 126, cover plate 128, cover 130, and lower portion 116 together. Preferably, the base 126, cover plate 128, cover 130, and lower portion 116 are held together tightly to prevent or reduce the penetration of air from the tank into the toilet ventilation device 100 (other than through the air inlet aperture). This can also prevent the flow of water into the upper portion 118 of the housing 102 and potential damage to the air movement apparatus and radar sensor.

The base 126 and cover 130 define an air exit channel 142 that extends from the air movement apparatus to the air outlet aperture 106. The filter is placed within this air exit channel 142. In some embodiments, the housing 102 may be configured so that the filter may be removable by partial or full disassembly of the device and/or through the air outlet aperture without disassembly or only partial disassembly. This allows for replacement of the filter.

The base 126 and/or the cover 130 may also include ribs 134 where the filter (not shown) is placed. The ribs may, for example, provide a baffle to direct air flow into the filter. The ribs may also create a seal between the housing 102 and the filter.

In the illustrated embodiment, the radar sensor is disposed in a chamber 148 in the cover 130 above the air movement apparatus. The radar sensor is typically provided on a circuit board that is disposed in this chamber 148. It will be understood that the radar sensor may be disposed in other portions of the housing 102 or, in some embodiments, separated from the housing and connected to the air movement apparatus by a cord, wires, or other connection elements.

Figure 5D:
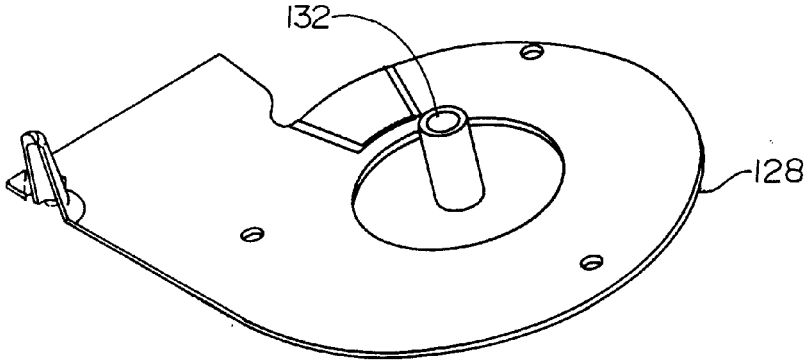
FIG. 5D is a perspective bottom view of the cover plate of FIG. 5B.

The radar sensor may be separated from the remainder of the interior of the upper portion 118 of the housing 102 by the cover plate 128 that protects the radar sensor, at least in part, from air and water in the toilet ventilation device and/or holds the air movement device. The cover plate 138 may be configured to allow wires, leads, or other connection elements to extend between the radar sensor and the air movement apparatus. FIG. 5D illustrates a bottom side of the cover plate 128 that includes a post 132 upon which the air movement apparatus (in the illustrated embodiment, a fan) is mounted.

The radar sensor and/or air movement apparatus may be operated using one or more batteries or using AC current from an outlet. If the air movement apparatus and/or radar sensor are operated using an AC current source, the base 126 and/or cover 130 may also include an opening 136 through which a cord 138 having a plug and, optionally, a voltage or current regulator 140 may extend (see FIG. 4).

The illustrated embodiment includes a fan as the air movement apparatus. To facilitate air flow, the toilet ventilation device 100 may be formed so that the air exit channel 142 is asymmetrically positioned with respect to the center of the fan. This configuration permits the fan 108, when rotated in the proper direction, to direct the air out through the air exit channel 142, without drawing substantial amounts of air back in through the air exit channel. In operation and referring to FIGS. 1, 2, 3, 4, and 5A to 5D, air flows from the air inlet aperture 104, along the channel 124, and into the upper portion 118 of the housing 102. The air is directed by the rotation of the fan around the center of the fan until it exits through the air exit channel 142, past the filter 110, and out the air outlet aperture 106 into the tank 152. In this embodiment, the fan blows air through the filter 110 and out the air outlet aperture. In other embodiments, the filter may be positioned within the device so that air is drawn through the filter to the fan and out the air outlet aperture.

In the illustrated embodiment, the direction of air flow is reversed by the air movement apparatus (e.g., the fan). The air travels along the channel 124 in one direction is then directed along the air exit channel 142 in the opposite direction. This is an example of "folded" air flow. Other embodiments may not have this particular type of air flow. One advantage of "folded" air flow is that the toilet ventilation device can be formed with a relatively slim profile that permits placement in toilet tanks with only small clearance between the top of the tank and the normal or overflow water level.

A variety of different air movement apparatuses can be used, including fans, bellows (expanded and contracted by, for example, piezoelectric devices), and suction devices. The illustrated embodiment includes a fan. Suitable fans include, for example, brushless DC fans, AC brushed fans, centrifugal fans, variable speed fans, and axial mounted fans.

The air movement apparatus is electrically coupled to the radar sensor so that the air movement apparatus can be turned on and, optionally, off as directed by the signals received from the radar sensor. Optionally, a manual switch may also be coupled to the air movement apparatus so that a user can manually turn the air movement apparatus on and off. This manual switch may be provided on the housing or may extend from the housing to be disposed, for example, on the outside of the tank 152 of the toilet 150 or on or near the seat of the toilet.

A variety of different filters can be used. Typically, the filter 110 contains an active material that adsorbs, absorbs, or reactively removes at least a portion of the malodorous elements from the air drawn into the toilet ventilation device 100. This active material may form the structure of the filter and/or the filter may contain a support material upon which the active material is adhered, adsorbed, embedded or otherwise disposed on or in. The active material may remove, adsorb, or absorb chemicals, such as, for example, methyl mercaptan and hydrogen sulfide. Typically, the filter has macroscopic air channels and/or the filter is composed of a porous material to allow the passage of air through the filter, but still bring the air into contact with the active material of the filter. Examples of suitable active materials include activated carbon and catalytically active metal oxides. Suitable filters include, for example, extruded cubes of porous filter material, filters with honeycomb-shaped channels, and filter material disposed on a mesh. One suitable filter is Model No. AKH12WLC 60/0560/40, Kobe Steel, Ltd., Fujisawa, Japan.

Figure 14:
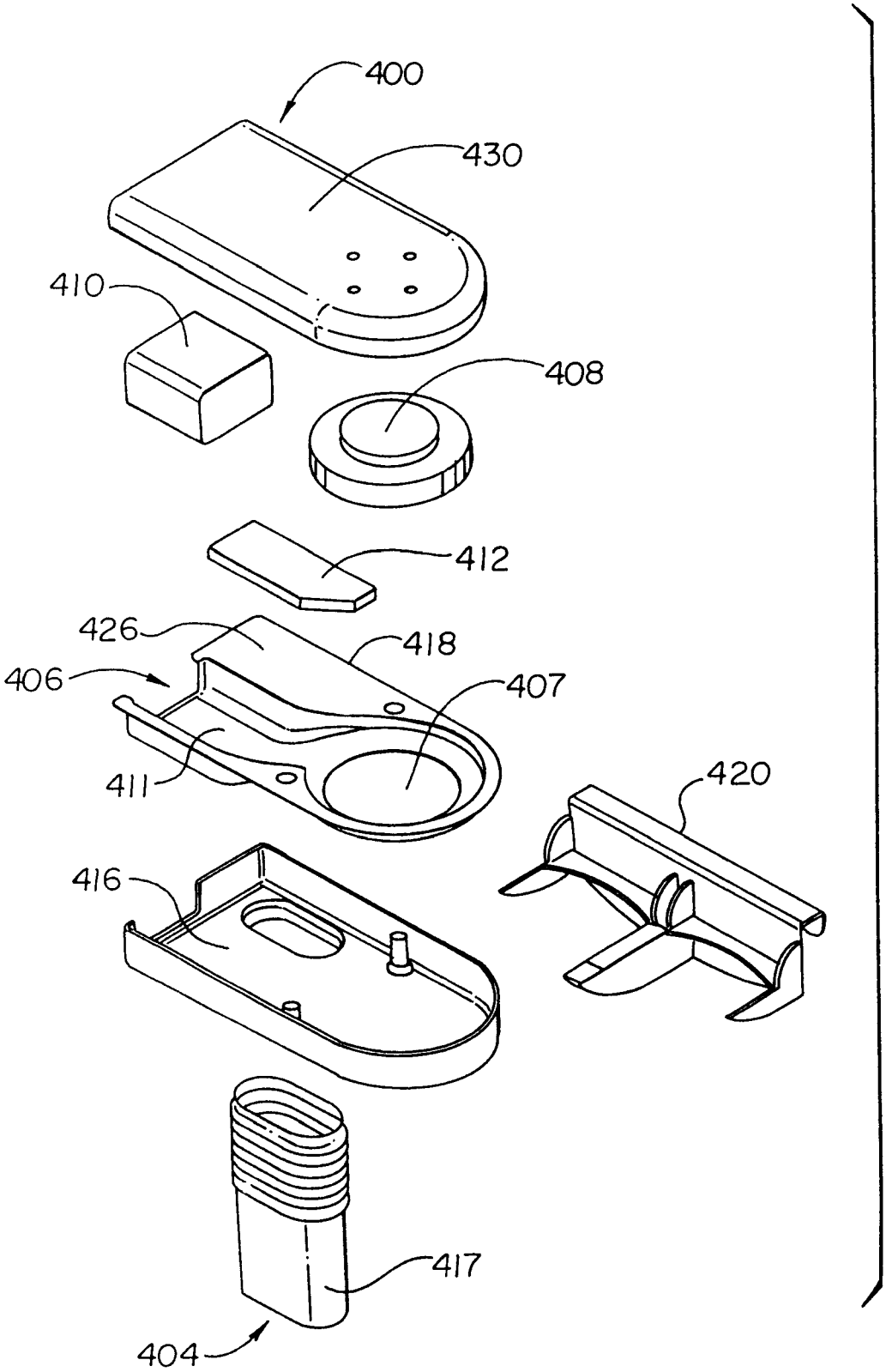
FIG. 14 is an expanded perspective view of another embodiment of a toilet ventilation device, according to the invention.

FIG. 14 illustrates another example of a toilet ventilation device. The toilet ventilation device 400 includes a lower housing having a foundation portion 416 onto which is attached a snorkel portion 417 that fits over the overflow conduit of the toilet to form the air inlet aperture 404. A base 418 of an upper portion of the housing fits with the foundation portion 416 of the lower housing and includes an air aperture 407 through which air can be drawn by the air movement apparatus 408. A filter 410 also fits into the base 418 for filtering air blown through an air exit channel 411 by the air movement apparatus 408. After filtering, the air exits through the air outlet aperture 406. The radar sensor 412 is positioned to one side of the air exit channel 411. The cover 430 is fit on the base 418 and, preferably, separates the radar sensor 412 from the remainder of the toilet ventilation device 400, except for connections to the air movement apparatus 408, to reduce or prevent damage to the radar sensor 412 by water in the toilet ventilation device 400.

Radar Sensors

A radar sensor 112 is a useful device for detecting an individual and/or actions of an individual in a sensor field. Radar sensors may be placed within the toilet, for example, in a toilet tank, and operated without a special window and without exposure to the exterior of the toilet. This allows for convenient, unobtrusive disposition of the toilet ventilation system and may, at least in some instances, allow retrofit of existing toilets with little or no need to alter the existing toilet hardware.

Figure 6:
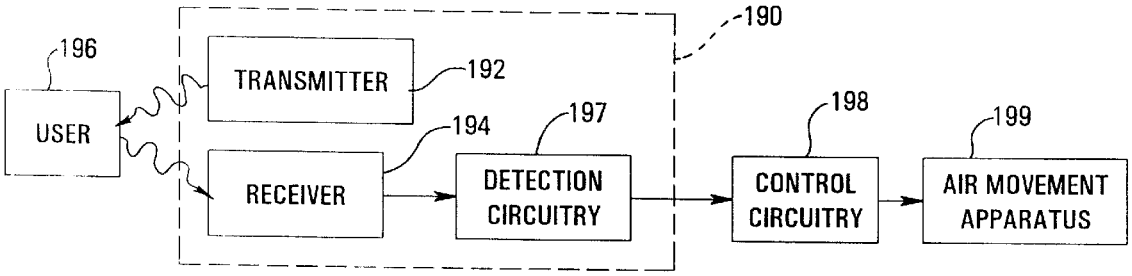
FIG. 6 is a schematic block diagram of one embodiment of a radar sensor, according to the invention.

FIG. 6 schematically illustrates radar detection. In general, radar detection is accomplished by transmitting a radar signal from a transmitter 192 and receiving reflections of the transmitted radar signal at a receiver 194. The reflections arise from the interaction of the radar signal with an object, such as a user 196. The strength of the reflected signal depends, in part, on the reflectivity and size of the object, as well as the distance to the object. The reflections received by the receiver 194 are then provided to detection circuitry 197 that determines, for example, the presence or absence of a user and, via control circuitry 198, operates a device, such as an air movement apparatus 199.

A variety of radar transmitters can be used. One type of radar transmitter continuously radiates an electromagnetic signal, often at a single frequency. One method for obtaining information from this signal is to measure the frequency of the reflected signal. If the object that reflects the signal is moving, the frequency of the reflected signal may be Doppler-shifted and provide motion and direction information. For example, an object moving away from the radar sensor causes the frequency of the reflected signal to decrease and an object moving towards the sensor causes the frequency of the reflected signal to increase. It will be appreciated that there are other continuous-wave radar systems and methods that can be used to obtain presence, position, motion, and direction information concerning an individual in the radar sensor field. These radar systems and methods may also be used in the devices of the invention.

Figure 7:
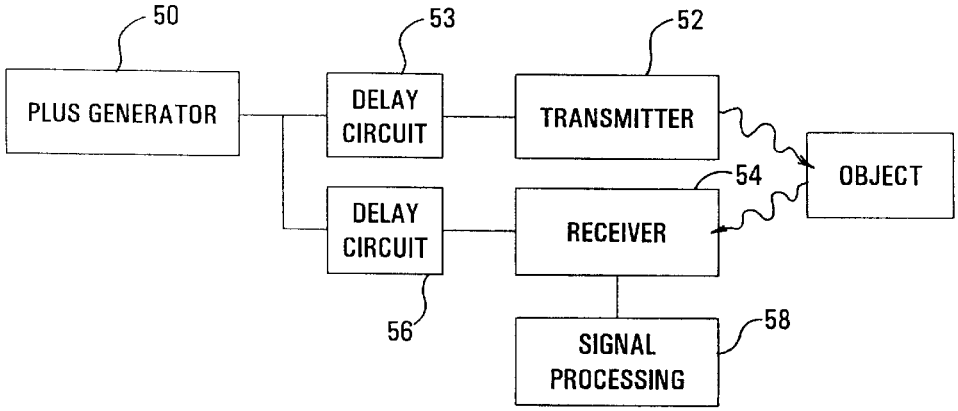
FIG. 7 is a schematic block diagram of a second embodiment of a radar sensor, according to the invention.

Another type of suitable radar system is pulsed radar in which pulses of electromagnetic energy are emitted by a transmitter and reflected pulses are received by a receiver. One pulsed radar configuration is schematically diagrammed in FIG. 7. This radar system includes a pulse generator 50 that generates pulses at a pulse repetition frequency (PRF), a transmitter 52 that transmits a radar signal in response to the pulses, an optional transmitter delay circuit 53 for delaying the radar signal, a receiver 54 for receiving the reflected radar signal, an optional receiver delay circuit 56 for gating open the receiver after a delay, and signal processing circuitry 58 for obtaining the desired presence, position, motion, and/or direction information from the reflected radar signal.

In one type of pulsed radar, a burst of electromagnetic energy is emitted at a particular RF frequency, the length of the burst corresponding to multiple oscillations of RF energy at the radar frequency. One example of a radar system using RF frequency radar bursts is described in detail in U.S. Pat. No. 5,521,600, incorporated herein by reference. In this particular radar system, the transmit and receive signals are mixed in receiver 54 before signal processing.

Figure 8:
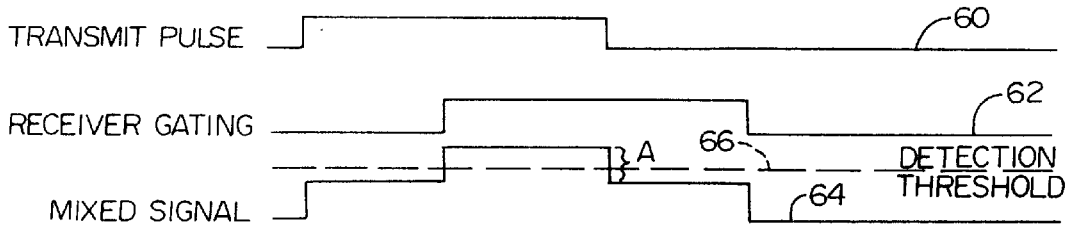
FIG. 8 includes schematic timing diagrams for the operation of one embodiment of a pulsed radar sensor, according to the invention.

A timing diagram for this particular radar system is provided in FIG. 8 which illustrates the transmitted RF burst 60, the receiver gating signal 62, and the mixed transmitter and receiver signal 64. The detection threshold 66 of the circuit may be set at a value high enough that only a mixed transmitter and receiver signal triggers detection. This radar system has a maximum detection range. Detectable signals arise only from objects that are close enough to the transmitter and receiver so that at least a portion of a transmitted burst travels to the object and is reflected back to the receiver within the length of time of the burst. The sensor field of this radar system covers the area within the maximum range of the radar system. Any object within that sensor field may be subject to detection.

Figure 9:
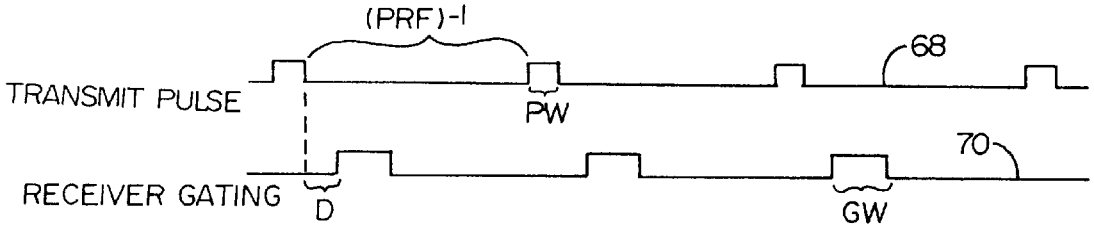
FIG. 9 includes schematic timing diagrams for the operation of another embodiment of a pulsed radar sensor, according to the invention.

Another type of pulsed radar system is ultra-wideband (UWB) radar which includes emitting pulses having nanosecond or subnanosecond pulse lengths. Examples of UWB radar systems can be found in U.S. Pat. Nos. 5,361,070 and 5,519,400, incorporated herein by reference. These UWB radar systems are also schematically represented by FIG. 7. However, for UWB radar systems the timing of the transmit pulse 68 and receiver gating 70, illustrated in FIG. 9, is significantly different from the above-described RF-burst radar systems. Transmit pulses are emitted by transmitter 52 at a pulse repetition frequency (PRF) determined typically by pulse generator 50. In some embodiments, the pulse repetition frequency may be modulated by a noise source so that transmit pulses are emitted at randomly varying intervals having an average interval length equal to the reciprocal of the pulse repetition frequency. Receiver 54 is gated open after a delay period (D) which is the difference between the delays provided by the receiver delay circuit 56 and the transmitter delay circuit 53. In UWB radar systems, the transmit pulses have a short pulse width (PW), typically, for example, 10 nanoseconds or less. The receiver is typically gated open after the transmitter pulse period, in contrast to the previously described RF burst radar systems in which the receiver is gated open during the transmitter pulse period.

Figure 10:
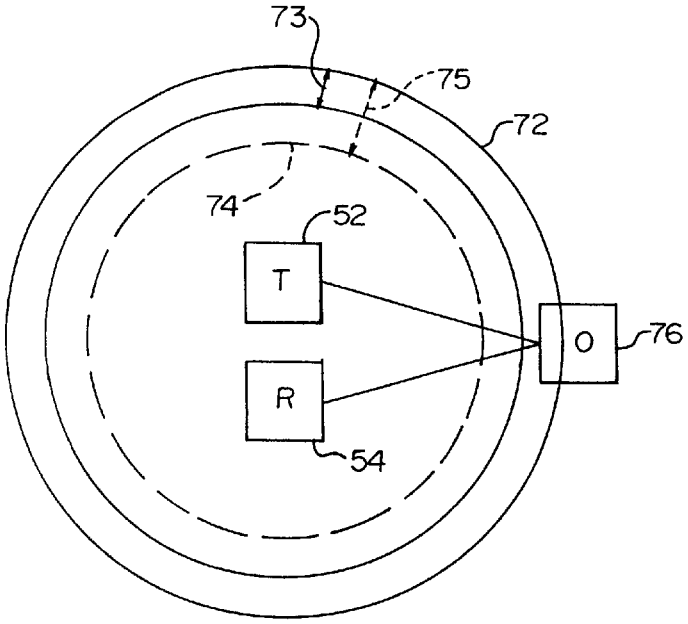
FIG. 10 is a schematic diagram of the operation of a pulsed radar sensor, according to the invention.

In UWB systems, the delay period and length of the receiver gating and transmitter pulses define a detection shell 72, illustrated in FIG. 10. The detection shell defines the effective sensor field of the UWB radar system. The distance between the radar transmitter/receiver and the detection shell is determined by the delay period, the longer the delay period the further out the shell is located. The width 73 of the shell depends on the transmit pulse width (PW) and the receiver gate width (GW). Longer pulse widths or gate widths correspond to a shell 74 having greater width 75. Using UWB radar systems, characteristics of an object 76 in the shell, such as presence, position, motion, and direction of motion of an object, can be determined.

In some embodiments, two or more gating pulses with different delay times are used. The gating pulses may alternate with each timing pulse or after a block of timing pulses (e.g., one gating pulse is used with forty timing pulses and then the second is used with the next forty timing pulses). In other embodiments, a controller may switch between the two or more gating pulses depending on circumstances, such as the detection of a user. For example, a first gating pulse may be used to generate a detection shell that extends a particular distance from the fixture. Detection of the user may start the air movement apparatus of the toilet ventilation device. Once a user is detected, a second gating pulse may be used that generates a detection shell that is closer or further away than the first shell. Once a user leaves this second detection shell, the air movement apparatus may be deactivated. The controller then resumes using the first gating pulse in preparation for another user. In yet other embodiments, more than one gating pulse is provided per transmit pulse, thereby generating multiple detection shells.

A potentially useful property of some UWB transmitters is that the transmitter antenna often continues to ring (i.e., continues to transmit) after the end of the pulse. This ringing creates multiple shells within the initial detection shell 72 thereby providing for detection of objects between detection shell 72 and the radar transmitter/receiver.

In either the RF-burst or UWB radar systems, delay circuits 53, 56 provide a fixed or variable delay period. A variable delay circuit may be continuously variable or have discrete values. For example, a continuously variable potentiometer may be used to provide a continuously variable delay period. Alternatively, a multi-pole switch may be used to switch between resistors having different values to provide multiple discrete delay periods. In some embodiments, delay circuits 53, 56 may simply be a conductor, such as a wire or conducting line, between pulse generator 50 and either transmitter 52 or receiver 54, the delay period corresponding to the amount of time that a pulse takes to travel between the two components. In other embodiments, delay circuits 53, 56 are pulse delay generators (PDG) or pulse delay lines (PDL).

Because of their versatility, radar systems can detect various characteristics of an individual in a radar sensor field (i.e., within the radar's detection range). For example, the presence of an individual can be detected from the strength of the return signal. This return signal can be compared with a background signal that has been obtained in the individual's absence and stored by the detector.

Another type of presence detector includes a transmitter and receiver separated by a region of space. The receiver is only gated open for a period of time sufficient to receive a signal directly transmitted from the transmitter. If the signal is reflected or blocked, it either does not arrive at the receiver or it arrives after the receiver is gated closed. This type of detector can be used, for example, as a "trip wire" that detects when an individual or a portion of an individual is interposed between the transmitter and receiver. Presence of an individual is indicated when the signal received during the gating period is reduced or absent.

Position of the individual in the sensor field can be determined, for example, by sweeping through a series of increasingly longer, or later, receiver gating pulses. The detection of a reflected signal, optionally after subtraction of a background signal, indicates the distance of the individual away from the radar system.

Motion of an individual can be determined by a variety of methods including the previously described Doppler radar system. An alternative method of motion detection is described in U.S. Pat. Nos. 5,361,070 and 5,519,400 in which a received signal is bandpass filtered to leave only those signals that can be ascribed to human movement through the sensor field. For example, the bandpass filter can be centered around 0.1 to 100 Hz.

U.S. Pat. No. 5,519,400 also describes a method for the determination of the direction of motion of an individual. This method includes the modulation of the delay period by ¼ of the center frequency of the transmission pulse to obtain quadrature information that can be used to determine the direction of motion of an object in the sensor field (e.g., toward and away from the detector).

Another method for detecting direction of motion is to compare consecutive signals or signals obtained over consecutive periods of time. For many radar systems, the reflected signal strength increases as an individual moves closer. As the individual moves further away, the signal typically decreases. The comparison of successive signals can then be used to determine the general direction of motion, either toward or away from the radar detector.

One or more characteristics of an individual in the sensor field, such as presence, position, motion, or direction of motion, may be simultaneously or sequentially detected by one or more sensors. This information may be coupled into the control circuitry which determines an appropriate action. A microprocessor may be used to control the air movement apparatus based on these multiple pieces of information. Alternatively, less sophisticated circuitry, such as a comparator, may be used to determine a characteristic, such as presence or motion, of the user in the sensor field. It will be appreciated that other methods may also be used to determine the presence, position, motion, and direction of motion of an individual in a radar sensor field.

Figure 11:
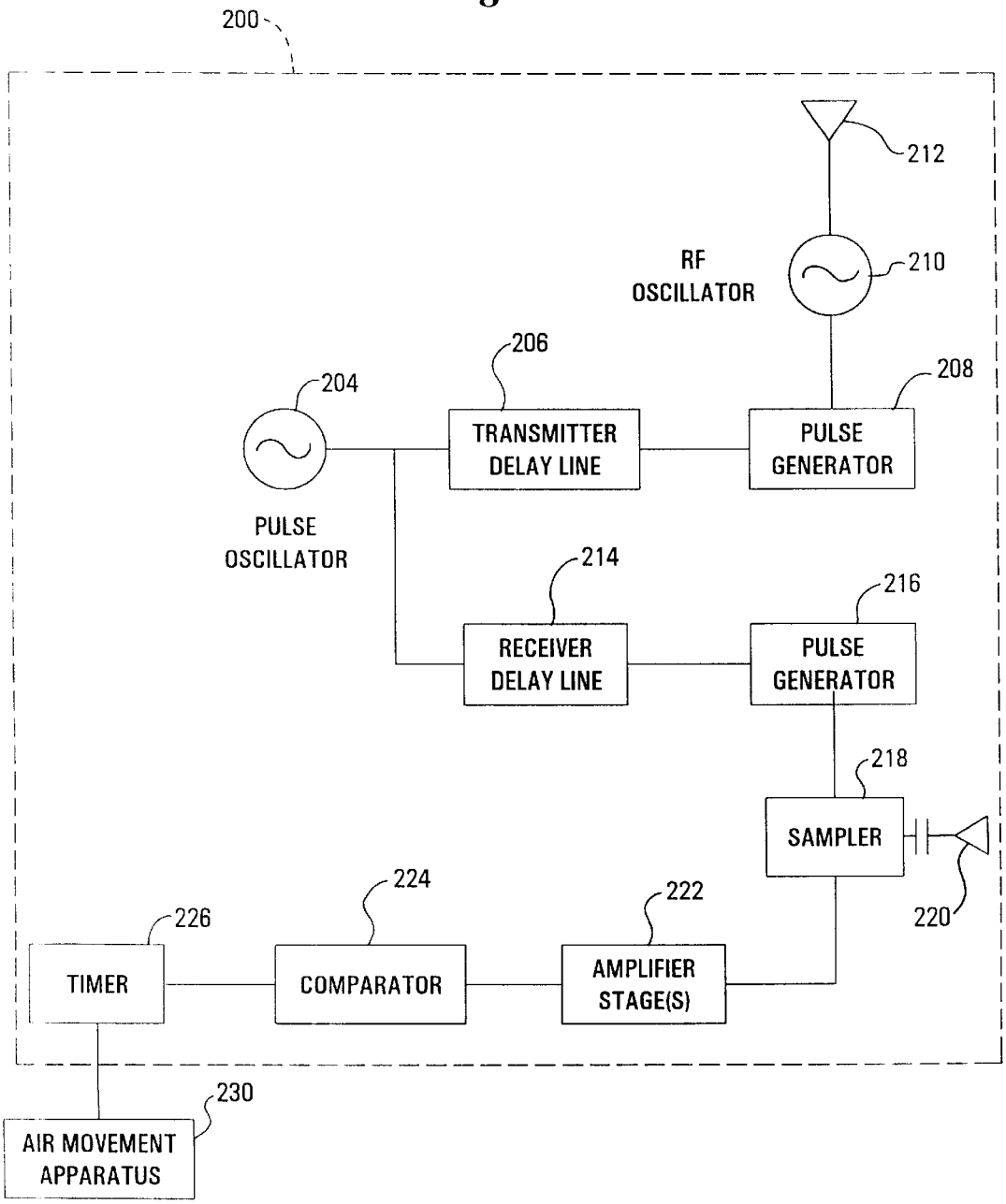
FIG. 11 is a schematic block diagram of a third embodiment of a radar sensor, according to the invention.

One embodiment of a suitable radar sensor is illustrated schematically in FIG. 11. The radar sensor 200 includes a pulse oscillator 204, an optional transmitter delay line 206, a transmitter pulse generator 208, an RF oscillator 210, a transmitter antenna 212, a receiver delay line 214, a receiver pulse generator 216, a sampler 218, a receiver antenna 220, one or more amplifier stages 222, a comparator 224 (or other processing circuitry), and an optional timer 226. The radar sensor 200 is coupled to the air movement apparatus 230 of the toilet ventilation device.

The pulse oscillator 204 provides a series of signals at a pulse repetition frequency (PRF). Optionally, the pulse oscillator may be coupled to a noise generator as described above, to vary the oscillation frequency. The pulse oscillator may operate at a frequency in the range of, for example, 0.3 to 20 MHz, or 0.5 to 5 MHz. Higher or lower oscillator rates may be used depending on factors, such as, for example, the application and the desired power usage. In some instances, the pulse oscillator may be adjustable (e.g., have an adjustable component, such as a potentiometer or adjustable capacitor, or by adjusting the positions of components relative to each other) so that the PRF can be changed over a range. This may be useful in situations where there is more than one toilet with a toilet ventilation device. Each device can use a different PRF so that the radar signals from one device do not contribute consistently to the signals obtained at the receiver of another device.

The pulse signals from the pulse oscillator 204 are provided along an optional transmitter delay line 206 to a transmitter pulse generator 208 that produces a pulse with a particular pulse length. The optional transmitter delay line 206 may provide a selected delay to the transmission pulses to produce a selected difference in delays between the transmitter and receiver pulses. In some embodiments, the transmitter delay line 206 is used to provide a delay of, for example, one quarter wavelength of an RF oscillator frequency to allow for quadrature detection, as described below.

The transmitter pulse generator 208 provides a pulse with a particular pulse length at each pulse from the pulse oscillator 204. Alternatively, the transmitter pulse oscillator 204 may provide pulses of the pulse length so that a separate pulse generator is not needed. The width of the pulse determines, at least in part, the width of the detection shell, as described above. The pulse width may be in the range of, for example, 1 to 20 nanoseconds, but longer or shorter pulse widths may be used.

The pulse is provided to an RF oscillator 210 that operates at a particular RF frequency to generate a pulse of RF energy at the RF frequency. The pulse of RF energy has a pulse-width as provided by the transmitter pulse generator 208 and a pulse rate determined by the pulse oscillator 204. The RF frequency may be in the range of, for example, 1 to 100 GHz, 2 to 25 GHz, or 3 to 8 GHz, however, higher or lower RF frequencies may be used. In at least some embodiments, the RF frequency may be variable so that different radar sensors can be set at different frequencies to reduce interference between neighboring sensors.

The pulses of RF energy are provided to a transmitter antenna 212 for radiating into space, as described above. The short duration of the pulses typically results in the irradiation of an ultra-wideband (UWB) signal. In addition, the transmitter antenna 212 may ring, thereby providing multiple detection shells for each pulse. In at least some embodiments, the antenna is formed as a metal tracing on a circuit board. This configuration has the advantage of occupying less space than other antenna configurations. However, it will be understood that other antenna configurations can be used when desired or necessary. The antenna may be directionally oriented (i.e., have a directional dependence on the strength of the signal emitted by the antenna). When a directional antenna is used, the preferred direction is typically toward the front of the toilet.

The pulse oscillator 204, in addition to producing pulses for the transmitter, also provides pulses to gate open the receiver. The use of the same pulse oscillator 204 for the transmitter and receiver portions of the radar sensor 200 facilitates timing between these two portions of the radar sensor. Pulses from the pulse oscillator 204 are sent to a receiver delay line 214 that delays the pulses by a desired time period to determine, at least in part, the distance of the detection shell from the radar sensor, as described above. The receiver delay line 214 may be capable of providing only one delay or two or more different delays that can be chosen, as appropriate, to provide different radar ranges. The receiver delay may be selected in the range of, for example, 10 to 100 picoseconds. The receiver delay may be selected to provide a detection shell at a distance within a range of, for example, zero to 6 feet or 1 to 2 feet. In at least some embodiments, the receiver delay may be variable (e.g., contain a variable component, such as a potentiometer) so that a receiver delay may be selected.

After being delayed, the pulses are provided to a receiver pulse generator 216 that generates a receiver pulse with a particular pulse width. The width of this pulse, as well as the width of the transmitter pulse, determine, at least in part, a width of the detection shell, as described above. Only during the receiver pulse is the receiver gated open to receive radar signals. The pulse width of the receiver pulse typically ranges from zero to one-half of the RF cycle time (e.g., zero to 86 picoseconds at a 5.8 GHz transmit frequency), and often, from one-quarter to one-half of the RF cycle time (e.g., 43 to 86 picoseconds at a 5.8 GHz transmit frequency). However, longer pulse widths may also be used. The time period during which the receiver is gated open (i.e., the pulse width of the receiver pulse) is referred to herein as the "gating time period".

The sampler 218 is designed to obtain the receiver signals from the receiver antenna 220 only during the receiver pulse and deliver that signal to the amplifier stage(s) 222. Examples of suitable samplers include single- or double-diode samplers. The diode or diodes may be, for example, forward-biased during the period of the receiver pulse and reverse-biased otherwise. Diodes may be sensitive to heat generated in the toilet ventilation device. In some instances, to reduce the temperature dependence of the diode(s) of the sampler 218, the diode(s) may be provided under a protective cover so that fluctuations in external temperature have little or reduced effect on the diode(s). In other instances, the diodes may be biased to reduce variation due to temperature fluctuations.

The receiver signal is provided from the sampler 218 to one or more amplifier stages 222. Multiple amplifier stages may be used to provide simultaneous outputs from multiple transmitter and receiver delay line settings.

After amplification, the signal is processed to detect absence or presence of a user. In some instances, the absence or presence of a user is determined by the strength of the reflections at or near 0 Hz. In other instances, the absence or presence of a user are determined by movements at about 0.2 to 20 Hz. This allows removal of the DC signal.

The processing of the signal may be accomplished using processing circuitry, such as a microprocessor or other circuitry or hardware, that can provide, as output, an indication of the presence or absence of a user and/or the presence or absence of motion of the user). One example of a suitable and relatively simple processor includes a comparator that compares the strength of a signal (e.g., an amplitude of a DC signal or a peak-to-peak, peak, or rms (root mean square) value of an AC signal at one frequency or over a frequency range) to a threshold value. In some instances, the comparator may determine if the signal is within or outside of a specific range. For example, a signal that produces a peak voltage outside a range of ±50 mV may indicate a user.

The signals from the comparator 224 may be directly used to turn the air movement apparatus 230 on and off. As one alternative, the signals from the comparator 224 may be provided to an optional timer 226. The timer 226 may be configured to require that the signal from the comparator 224 indicate the presence of a user for a detection period before turning on the air movement apparatus 230. For example, the timer 226 may include a capacitor that is charged by the signal from the comparator. The air movement apparatus turns on when the capacitor is charged to a particular level. Examples of suitable detection periods include, but are not limited to, three seconds, five seconds, or ten seconds.

The timer 226 may also control when the air movement apparatus is turned off. The timer 226 may be configured to require that the signal from the comparator 224 indicate the absence of a user for a non-detection period before turning off the air movement apparatus 230. Suitable examples of non-detection periods include, but are not limited to, ten seconds, thirty seconds, and one minute. One alternative to detecting the absence of a user is to operate the air movement apparatus for a fixed period of time (e.g., five, ten, or fifteen minutes) after the air movement apparatus has been turned on. After the fixed period of operation, the air movement apparatus is turned off. The radar sensor may remain active during the period that the air movement apparatus is on or the sensor may be held inactive until the air movement apparatus turns off.

The detection period and the non-detection period need not be the same length of time. In at least some instances, the non-detection period is longer than the detection period so that it takes a large, consistent signal to turn on the air movement apparatus, but only small (even irregular) signals are needed to keep the air movement apparatus on. In one embodiment, when the air movement apparatus is turned off, the timer is reset to the fully-off state (e.g., the capacitor is rapidly discharged) to prevent restarting the air movement apparatus using a relatively weak signal.

The air movement apparatus 230 is coupled to and controlled by the radar sensor 200. In some instances, the air movement apparatus 230 is also coupled to a regulator (not shown) to reduce variations in the AC or DC voltage and consequent variations in air movement apparatus speed.

Low Power Radar Sensor

A radar sensor for use with a toilet ventilation device can operate using either AC or DC power. Although in many cases the radar sensor may operate using available AC power from an outlet, it may be convenient to use battery power instead. For example, radar sensors may not be conveniently or aesthetically connectable to an outlet. In such cases, a battery-powered radar sensor may be desirable. However, it is also desirable that the lifetime of the batteries in the sensor be measured on the order of months or years. Thus, the development of low power radar sensors is desirable.

Often pulsed sensors use less power than those that operate continuously. Moreover, generally, the fewer pulses emitted per unit time, the less power needed for operation of the sensor. However, sensitivity often decreases with a decrease in pulse rate. In addition, it has been found that decreasing the pulse rate can also raise the impedance of a sampler in the receiver. This can place limits on the bandwidth of the sensor because even small amounts of stray capacitance can cause the frequency response of the receiver to roll off at very low frequencies. In addition, high output impedance may place stringent requirements on subsequent amplifier stages and provide a very susceptible point in the circuit for noise coupling.

Figure 12:
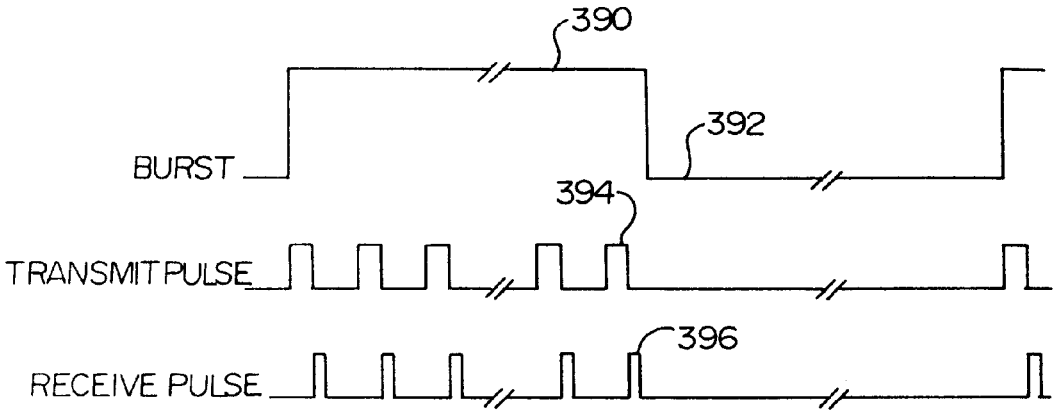
FIG. 12 includes schematic timing diagrams for the operation of yet another embodiment of a pulsed radar sensor, according to the invention.

One example of a low power radar sensor operates by providing radar pulses that are non-uniformly spaced in time. In operation, a burst 390 of pulses 394 is initiated in the transmitter, as shown in FIG. 12. Between each burst is a period 392 of rest time in which the transmitter is not transmitting RF energy. For example, a 1 to 100 microsecond burst of RF pulses may be made every 0.1 to 5 milliseconds. The RF pulses may be provided at, for example, a 0.5 to 20 MHz rate within the burst with an RF frequency ranging from, for example, 1 to 100 GHz. In this way, there is a relatively high pulse rate during the burst period, but with overall low power because the bursts only occur for 5% or less of the period between bursts. Although, the sensitivity of this radar sensor may be approximately the same as a radar sensor with the same number of pulses uniformly spaced in time, the impedance of the sampler during the burst period can be much less. In some embodiments, however, the burst period may be 10%, 25%, 50%, or more of the time between bursts.

Figure 13:
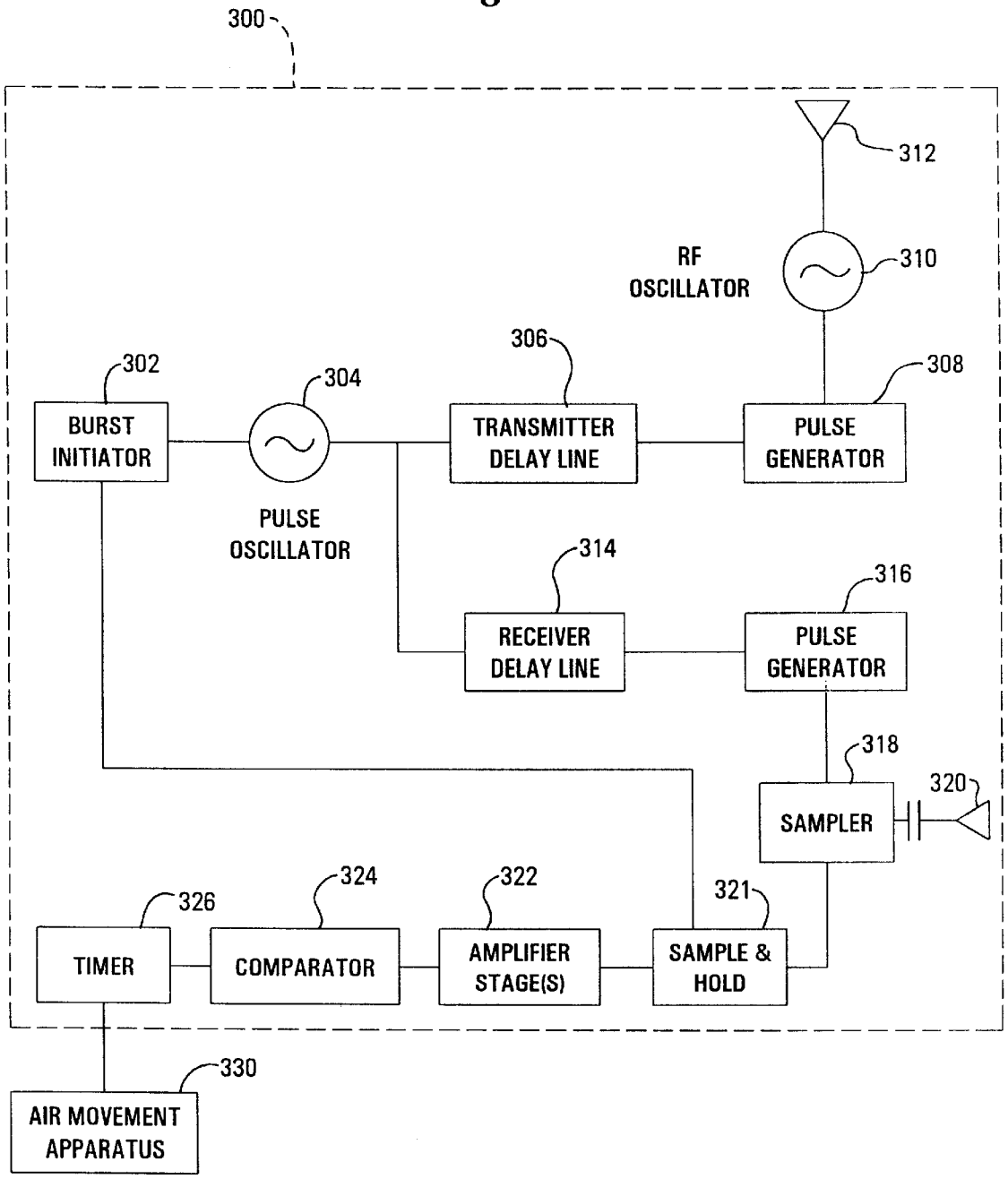
FIG. 13 is a schematic block diagram for a fourth embodiment of a radar sensor, according to the invention.

One exemplary low power radar sensor 300 is illustrated in FIG. 13. The radar sensor 300 includes a burst initiator 302 that triggers the beginning of the burst and may, optionally, trigger the end of the burst. A burst rate is defined as the rate at which bursts are provided. The burst width is the length of time of the burst. The time between bursts is the rest period. For many applications, the burst rate can range from, for example, 200 Hz to 10 kHz and often from, for example, 500 Hz to 2 kHz. The burst width can range from, for example, 1 to 200 microseconds and often from, for example, 5 to 100 microseconds. However, higher or lower burst rates and longer or shorter burst widths may be used. The particular burst rate and burst width may depend on factors, such as the application and the desired power usage. An exemplary burst 390 is illustrated in FIG. 12.

The burst starts a pulse oscillator 304 that provides the triggering signals for each pulse. The pulse oscillator may operate in a frequency in the range of, for example, 0.5 to 20 MHz, or 2 to 10 MHz to provide, for example, 5 to 2000 pulses per burst. Higher or lower oscillator rates and larger or smaller numbers of pulses per burst may be used, depending on factors, such as, for example, the application and the desired power usage.

These triggering signals are provided along an optional transmitter delay line 306 to a pulse generator 308 that produces a pulse with a desired pulse length. The optional transmitter delay line 306 may provide a desired delay to the transmission pulses to produce a desired difference in delays between the transmitter and receiver pulses. In some embodiments, the transmitter delay line 306 is used to provide a delay of, for example, one quarter wavelength of an RF oscillator frequency to allow for quadrature detection, as described below.

The pulse generator provides a pulse with a desired pulse length at each pulse from the pulse oscillator. The width of the pulse determines, at least in part, the width of the detection shell, as described above. The pulse width may be in the range of, for example, 1 to 20 nanoseconds, but longer or shorter pulse widths may be used. An example of the pulses 394 from the pulse oscillator is provided in FIG. 12.

The pulse is then provided to an RF oscillator 310 that operates at a particular RF frequency to generate a pulse of RF energy at the RF frequency and having a pulsewidth as provided by the pulse generator 308 at a pulse rate determined by the pulse oscillator 304 during a burst period as initiated by the burst initiator 302. The RF frequency be in the range of, for example, 1 to 100 GHz or 2 to 25 GHz, however, higher or lower RF frequencies may be used.

The pulses of RF energy are provided to an RF antenna 312 for radiating into space, as described above. The short duration of the pulses typically results in the irradiation of an ultra-wideband (UWB) signal. In addition, the RF antenna 312 may ring, thereby providing multiple detection shells for each pulse.

The pulse oscillator 304, in addition to producing pulses for the transmitter, also provides pulses to gate the receiver. Pulses from the pulse oscillator 304 are sent to the receiver delay line 314 that delays the pulses by a time period to determine, at least in part, the distance of the detection shell from the radar sensor, as described above. The receiver delay line 314 may be capable of providing only one delay or a plurality of delays that can be chosen, as appropriate, to provide different radar ranges.

After being delayed, the pulses are provided to a receiver pulse generator 316 that generates a receiver pulse with a desired pulse width. The width of this pulse, as well as the width of the transmitter pulse, determine, at least in part, a width of the detection shell, as described above. Only during the receiver pulse is the receiver gated open to receive radar signals. The pulse width of the receiver pulse typically ranges from zero to one-half of the RF cycle time (e.g., zero to 86 picoseconds at a 5.8 GHz transmit frequency), and often, from one-quarter to one-half of the RF cycle time (e.g., 43 to 86 picoseconds at a 5.8 GHz transmit frequency). However, longer pulse widths may also be used. Receiver pulses 396 are only produced during the burst 390, as illustrated in FIG. 12. The receiver pulses 396 may or may not overlap with the transmitter pulses 394.

Receiver signals are received via the receiver antenna 320, but these signals are only sampled by the sampler 318 during the receiver pulses. The sampler 318 can be, for example, a single- or double-diode sampler, as described above for radar sensor 200.

The sampler 318 delivers these signals to a sample and hold component 321. Typically, the sample and hold component 321 includes a gate, coupled to the burst initiator 302, that can be opened between bursts to isolate the remainder of the circuit.

The remainder of the radar sensor, including the amplifier stages 322, the processor 324, and the optional timer 326, as well as the connection of the air movement apparatus 330, are as described above with respect to radar sensor 200. Additional examples and discussion of suitable radar sensors, and in particular, low power radar sensors, is provided in U.S. patent application Ser. No. 09/118,050, incorporated herein by reference.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A toilet ventilation device for disposition within a toilet, the toilet ventilation device comprising:

(a) a housing defining an air inlet aperture and an air outlet aperture;

(b) an air movement apparatus disposed in the housing;

(c) a filter disposed in the housing for removing malodorous elements from air; and (d) a radar sensor disposed in the housing and electrically coupled to the air movement apparatus to activate the air movement apparatus in response to a presence of a user, wherein the radar sensor is configured and arranged for disposition completely within the tank of the toilet and does not require a window formed in the tank for detection of a user of the toilet;

(e) wherein the toilet ventilation device is configured and arranged to draw air, using the air movement apparatus, from the toilet, through the air inlet aperture, into contact with the filter, and out the air outlet aperture.

2. The toilet ventilation device of claim 1, wherein the radar sensor comprises a pulsed RF transmitter that emits pulses of RF energy.

3. The toilet ventilation device of claim 2, wherein the radar sensor comprises a gated receiver to receive reflections of the RF energy only during a gating time period after each pulse from the pulsed RF transmitter.

4. The toilet ventilation device of claim 1, wherein the radar sensor comprises (i) a transmitter for emitting RF energy, (ii) a receiver for receiving reflections of the RF energy emitted by the transmitter, and (iii) processing circuitry to detect a user based on the reflections received by the receiver.

5. The toilet ventilation device of claim 4, wherein the processing circuitry comprises a microprocessor.

6. The toilet ventilation device of claim 4, wherein the processing circuitry comprises a comparator.

7. The toilet ventilation device of claim 4, wherein the radar sensor further comprises a timer configured and arranged to activate the air movement apparatus when the processor detects a user for a detection period.

8. The toilet ventilation device of claim 7, wherein the timer is configured and arranged to deactivate the air movement apparatus when the processor fails to detect a user for a non-detection period.

9. The toilet ventilation device of claim 8, wherein the non-detection period is longer than the detection period.

10. The toilet ventilation device of claim 7, wherein the timer comprises a capacitor and the detection period comprises a time period needed to charge the capacitor to a detection level.

11. The toilet ventilation device of claim 1, wherein the radar sensor is configured and arranged to determine the presence of a user by detecting motion of the user.

12. The toilet ventilation device of claim 1, further comprising a hanging assembly coupled to the housing of the toilet ventilation device to hang the toilet ventilation device from a sidewall of a tank of the toilet.

13. The toilet ventilation device of claim 1, wherein the toilet ventilation device is attached to an overflow conduit of the toilet.

14. The toilet ventilation device of claim 1, wherein the device is configured and arranged so that the air movement device blows air through the filter.

15. The toilet ventilation device of claim 1, wherein the radar sensor comprises a circuit board and at least one antenna disposed as a conductive trace on the circuit board.

16. The toilet ventilation device of claim 1, wherein the radar sensor is disposed over the air movement device.

17. A toilet ventilation device for disposition within a tank of a toilet and for removal of contaminants from at least a bowl portion of the toilet, the toilet ventilation device comprising:

(a) a housing defining an air inlet aperture and an air outlet aperture;

(b) an air movement apparatus disposed in the housing;

(c) a filter disposed in the housing; and (d) a radar sensor disposed within the housing, the radar sensor being electrically coupled to the air movement apparatus to activate and deactivate the air movement apparatus in response to a presence and absence of a user;

(e) wherein the toilet ventilation device is configured and arranged to be disposed over an overflow conduit of a toilet and, using the air movement apparatus, to draw air from the bowl of the toilet, through the overflow conduit, into the air inlet aperture of the housing, through the filter, and out the air outlet aperture of the housing.

18. A toilet ventilation device for removal of odors from air, comprising:

(a) a housing defining an air inlet aperture and an air outlet aperture;

(b) an air movement apparatus disposed in the housing; and (c) a radar sensor disposed within the housing and electrically coupled to the air movement apparatus to activate the air movement apparatus in response to detection of a user, wherein the radar sensor is configured and arranged for disposition completely within the tank of the toilet and does not require a window formed in the tank for detection of a user of the toilet, wherein the radar sensor comprises (i) a transmitter for emitting pulses of rf energy, (ii) a gated receiver for receiving reflections of the pulses of rf energy, wherein the gated receiver is only receptive to the reflections for a time period after each pulse of rf energy in which the receiver is gated open, and (iii) a processor for determining, in response to the reflections received by the receiver, whether a user is present.

19. A method of removing malodorous elements using a toilet ventilation device disposed within, the method including steps of:

(a) sensing, using a radar sensor, whether a person is proximate the toilet, wherein the radar sensor is disposed in the toilet ventilation device and the radar sensor is completely disposed within the tank of the toilet and does not require a window formed in the tank for detection of the person proximate to the toilet;

(b) operating an air movement apparatus, when the person is proximate the toilet, to draw air from a bowl of the toilet into the toilet ventilation device, wherein the air movement apparatus is disposed in the toilet ventilation device; and (c) removing malodorous elements in the air drawn from the toilet bowl using a filter disposed in the toilet ventilation device.

20. The method of claim 19, wherein operating an air movement apparatus comprises drawing air into the air movement apparatus and redirecting the air in an opposite direction out of the air movement apparatus.

21. The method of claim 19, wherein the step of operating the air movement apparatus comprises (i) drawing air from the bowl of the toilet, through an overflow conduit of the toilet, and into the toilet ventilation device in response to the presence of the user, wherein the toilet ventilation device comprises a housing defining an air inlet aperture and the overflow conduit of the toilet is disposed within the air inlet aperture.

22. The method of claim 19, wherein the step of sensing whether a person is proximate the toilet comprises (i) emitting a transmitter signal from a transmitter portion of the radar sensor;

(ii) receiving a receiver signal at a receiver portion of the radar sensor, the receiver signal comprising a portion of the radar signal reflected from any person proximate the toilet; and (iii) processing the receiver signal to determine if a person is proximate the toilet.

23. The method of claim 22, wherein the step of drawing air from the bowl of the toilet comprises activating the air movement apparatus when a person proximate the toilet is detected for a detection period.

24. The method of claim 23, wherein the step of drawing air from the bowl of the toilet further comprises deactivating the air movement apparatus when no person is detected proximate the toilet for a non-detection period.

25. The method of claim 22, wherein (i) the step of emitting a transmitter signal comprises emitting a plurality of radar pulses, and (ii) the step of receiving a receiver signal comprises receiving a receiver signal at a receiver portion of the radar sensor only during a time period after each radar pulse when the receiver portion of the radar sensor is gated open.

26. The method of claim 19, wherein removing malodorous elements comprises blowing air from the air movement apparatus through a filtering device and out an air outlet aperture of the toilet ventilation device.

* * * * *